United States Patent [19]

Hage

[11] 4,339,969

[45] Jul. 20, 1982

[54] RATCHET WRENCH

[76] Inventor: Albert Hage, 3700 Roanoke Rd., Toledo, Ohio 43613

[21] Appl. No.: 258,897

[22] Filed: Apr. 30, 1981

[51] Int. Cl.[3] ..... B25B 13/46

[52] U.S. Cl. ..... 81/57.39

[58] Field of Search ..... 81/57.39

[56] References Cited

U.S. PATENT DOCUMENTS 3,941,017 3/1976 Lenker et al. ..... 81/57.39

4,031,785 6/1977 Wheeler ..... 81/57.39

FOREIGN PATENT DOCUMENTS 850357 9/1970 Canada ..... 81/57.39

82355 1/1935 Sweden ..... 81/57.39

*Primary Examiner*—James L. Jones, Jr.

*Attorney, Agent, or Firm*—Wilson, Fraser, Barker & Clemens

[57] ABSTRACT

A ratchet wrench includes a housing, a ratchet wheel and pawl within the housing, and a bell crank linkage for effecting rotational movement of the ratchet wheel by pivotal movement of the bell crank relative to the housing.

1 Claim, 3 Drawing Figures

RATCHET WRENCH

BACKGROUND OF THE INVENTION

1. Field of the Invention

The invention relates to a ratchet wrench operable within confined areas by means of a bell crank arm pivotally mounted on the wrench handle.

2. Description of the Prior Art

Ratchet wrenches are well known. A common tool includes a drive member having a clamp for retaining the user's choice of a socket unit having an appropriate size for the task to be performed. The drive member is secured to a toothed ratchet wheel rotatably mounted within the tool handle, or housing. A pawl within the housing engages the ratchet wheel teeth to permit rotational movement in one direction only. When work space is restricted, such a tool may be moved back and forth through a small arc only, the ratcheting mechanism assuring that the socket is driven in one direction only.

In some work situations, even this common ratchet wrench is not suitable. For such applications, there is a need for a crank operated tool requiring less free space for operation.

SUMMARY OF THE INVENTION

The invention comprises a housing including a handle portion, in which are mounted a ratchet wheel and a cooperating pawl as in the conventional ratchet wrench tool. There is also provided a bell crank pivotally mounted within the housing. One arm of the bell crank is pivotally attached to a rectilinearly movable ratchet operating arm, which includes teeth engagable with the ratchet wheel. Hence, movement of the bell crank relative to the handle causes rotation of the ratchet wheel and the socket driver member, without the need for moving the housing of the tool in a constricted area.

BRIEF DESCRIPTION OF THE DRAWINGS

Other objects and advantages of the invention will hereinafter appear, and for purposes of illustration, but not of limitation, an embodiment of the invention is shown on the accompanying drawings, in which.

DESCRIPTION OF THE PREFERRED EMBODIMENT

Figure 1:
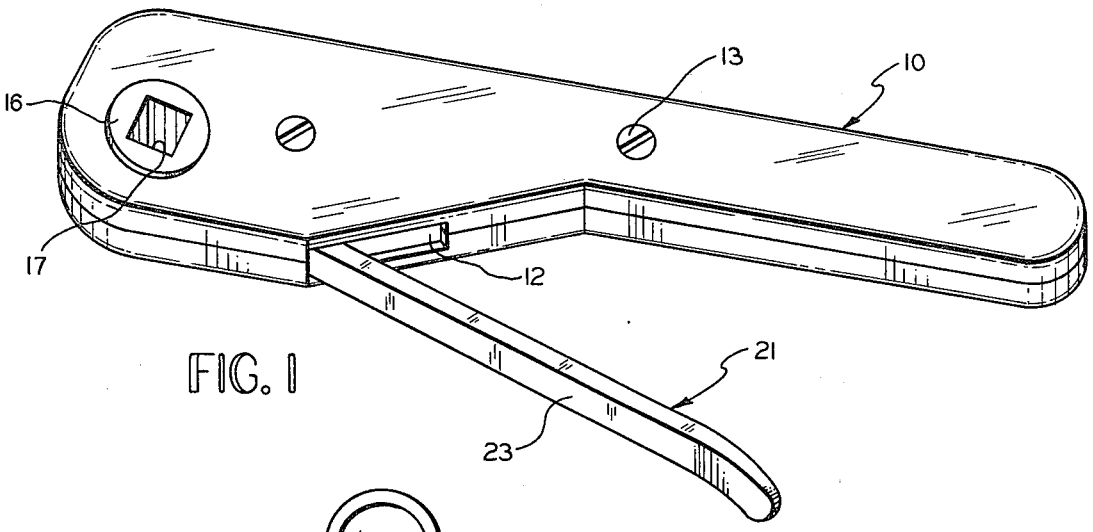
FIG. 1 is a perspective view of the ratchet wrench.
Figure 2:
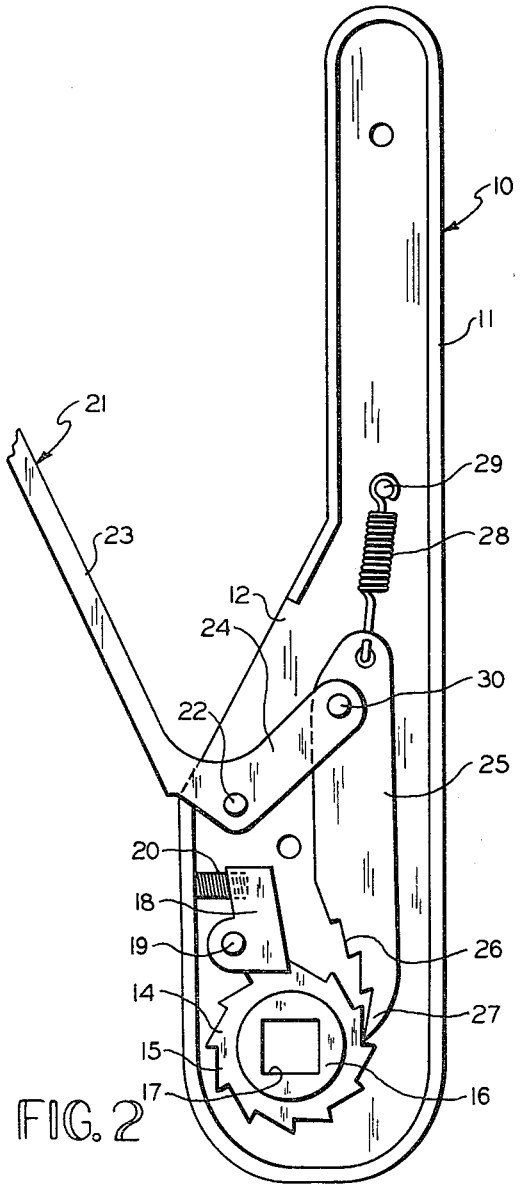
FIG. 2 is a plan view of the ratchet wrench, a portion of the housing being removed to reveal the working parts thereof.
Figure 3:
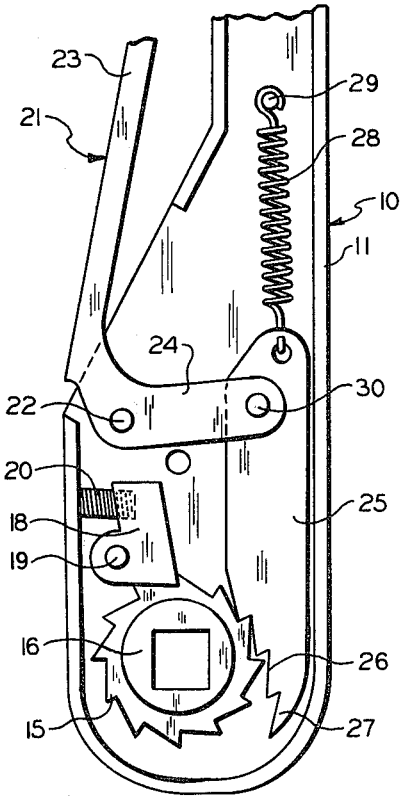
FIG. 3 is a plan view similar to FIG. 2 but showing the ratchet wheel actuated to the full limit of its movement by the operating arm.

The illustrated embodiment of the invention comprises a sheet metal housing 10 which is constructed in two parts. Each of the parts is provided with an edge flange 11 which extends entirely thereabout except to provide a lateral opening 12 for a purpose hereinafter to be described. In this instance a pair of screws 13 secure the two parts of the housing together.

Rotatably mounted at one end of the housing and disposed on the inside thereof is a ratchet wheel 14 which is provided with a series of peripheral teeth 15. On opposite sides of the ratchet wheel and disposed in openings in the housing parts are hub portions 16 which are rigid with the ratchet wheel 14. Concentric with the wheel 14 is a square hole 17 for nut-engaging purposes.

The shape of this hole may be varied as desired as will be readily understood.

For holding the ratchet wheel 14 against movement in one direction but permitting movement in the opposite direction is a detent arm 18 which is pivoted within the housing on a pivot 19 at one end and is resiliently urged into engagement with the toothed periphery of the ratchet wheel 14 by a coil spring 20.

For step-by-step ratchet operation, a bell crank lever 21 is pivoted within the housing 10 on a pivot 22. The bell crank is provided with an operating arm 23, the major portion of which extends outside of the housing 10 and is disposed within the elongate opening 12 so that the arm 23 is free for to and fro movements to effect turning movement of the ratchet wheel 14 as will hereinafter appear. The other arm 24 of the bell crank 21 is arranged within the housing 10 and is disposed at an angle of approximately 70° to the operating arm 23. It will be understood that in the operation of the arm 23 it is urged in a direction toward the housing 10 to effect ratchet movement.

Disposed within the housing 10 longitudinally thereof is a ratchet wheel operating arm 25 which is rectilinearly movable toward and away from the ratchet wheel 14. At the lower end of the arm 25 and on the inside thereof is a series of teeth 26 adapted progressively to engage teeth on the ratchet wheel 14 for imparting turning movement thereto. The lowermost tooth 27 is normally arranged first to engage a tooth on the ratchet wheel 14. As shown, it inclines inwardly to a pointed end so that when the arm 25 is moved downwardly or in a direction toward the ratchet wheel 14, the tooth 27 first engages a tooth 15 on the ratchet wheel 14. Upon further movement, the next succeeding tooth on the arm 25 engages a succeeding tooth on the ratchet wheel 14 and so on until the several teeth on the operating arm 25 will have engaged teeth on the ratchet wheel 14. In this manner the amount of rectilinear shifting movement of the arm 25 determines the amount of turning movement imparted to the ratchet wheel 14. As shown, the arm 25 is pivoted near its upper end at 30 to the outer end of the bell crank arm 24, a portion of the arm 25 projecting upwardly beyond the pivot 30. Connected to the upper end of the arm 25 is a contractile coil spring 28, the upper end of which is secured to an anchor pin 29 disposed within the housing 10.

In operation by depressing the bell crank arm 23 in a direction toward the housing, the ratchet wheel operating arm 25 is moved downwardly and the extent of movement of the arm 23 determines the extent of movement of the ratchet wheel 14. The greater the movement of the arm 23 toward the housing, the greater will be the turning movement imparted to the ratchet wheel 14 as above explained. Upon releasing the arm 23, the coil spring 28 abruptly moves the operating arm 25 upwardly and causes the bell crank arm 23 to be swung outwardly to its normal or original position.

It will be observed that lateral movement of the ratchet wheel operating arm 25 in one direction is prevented by the edge flanges 11 of the housing 10, the space between the arm 25 and the edge flanges 11 being predetermined so that liability of the arm 25 becoming disengaged from the ratchet wheel is eliminated. It will be observed that the housing 10 is elongate to provide at one end portion a handle for convenient operation thereof, Manifestly by rocking the handle in one direction, nut tightening can be effected. However where space does not permit, a nut can be tightened by manipulation of the bell crank arm 23 as above described.

Numerous changes in details of construction, arrangement and choice of materials may be effected without departing from the spirit of the invention, especially as defined in the appended claims.

What I claim is:

1. A ratchet wrench comprising:

(a) a housing of oblong form having an edge flange extending therearound provided with an elongate slot disposed along a portion of one side of the flange;

(b) a ratchet wheel rotatable in one end portion of said housing and having a toothed rim and a nut engaging opening concentric therewith;

(c) a spring-tensioned detent engaging said ratchet wheel for preventing rotative movement thereof in one direction;

(d) a bell crank operating lever pivoted in said housing and having one arm extending through the slot of the flange and projecting outside of said housing for manual step-by-step operation of said ratchet wheel and having its other arm disposed within said housing;

(e) a ratchet wheel operating arm having a plurality of successively arranged teeth at one end progressively engagable with the teeth of the toothed rim of said ratchet wheel;

(f) spring means interconnecting an end opposite the toothed end of said ratchet wheel operating arm and said housing effective for holding the toothed end of said operating arm in engagement with the teeth of the toothed rim of said ratchet wheel and retracting said operating arm and said bell crank operating lever to their original positions after release of said bell crank operating lever; and (g) a pivotal connection between the other arm of said bell crank and said ratchet wheel operating arm, said pivotal connection being disposed between the toothed end and the opposite end of said operating arm, whereby upon rocking movement of said bell crank operating lever about said pivotal connection said operating arm is caused to move longitudinally of said housing and, lateral movement of the toothed end of said operating arm away from said ratchet wheel is prevented by the adjacent portion of said edge flange of said housing to effect turning movement of said ratchet wheel.

* * * * *